US010844638B2

(12) United States Patent
Sud

(10) Patent No.: US 10,844,638 B2
(45) Date of Patent: Nov. 24, 2020

(54) RETRACTABLE CABLE LOCKING DEVICE

(71) Applicant: John Harris Sud, Tucson, AZ (US)

(72) Inventor: John Harris Sud, Tucson, AZ (US)

( * ) Notice: Subject to any disclaimer, the term of this patent is extended or adjusted under 35 U.S.C. 154(b) by 174 days.

(21) Appl. No.: 16/230,899

(22) Filed: Dec. 21, 2018

(65) Prior Publication Data

US 2020/0199913 A1 Jun. 25, 2020

(51) Int. Cl.

| | |
|---|---|
| ***E05B 71/00*** | (2006.01) |
| ***E05B 73/00*** | (2006.01) |
| ***E05B 15/04*** | (2006.01) |
| ***E05B 15/08*** | (2006.01) |
| *E05B 15/16* | (2006.01) |

(52) U.S. Cl.

CPC ..... *E05B 71/00* (2013.01); *E05B 15/08* (2013.01); *E05B 73/0011* (2013.01); *E05B 2015/0437* (2013.01); *E05B 2015/1692* (2013.01)

(58) Field of Classification Search

CPC ..... E05B 71/00; E05B 73/0011; E05B 15/08; E05B 2015/0437; E05B 2015/1692; E05B 73/0005; B65H 75/4476

USPC .... 70/14, 18, 30, 49, 53, 57.1, 58, 225–228, 70/233–236, DIG. 63; 211/5; 242/388.6; 248/551–553

See application file for complete search history.

(56) References Cited

U.S. PATENT DOCUMENTS 3,940,941 A 3/1976 Libert et al.
4,044,577 A * 8/1977 Horlacher ..... E05B 73/0011 70/234
4,086,795 A * 5/1978 Foster ..... B62H 5/003 70/233
4,112,720 A * 9/1978 Green ..... B62H 5/003 70/233
4,165,053 A * 8/1979 Konig ..... B65H 75/38 242/378.3
D269,410 S 6/1983 Johansson
D269,411 S 6/1983 Johansson
(Continued)

FOREIGN PATENT DOCUMENTS

WO 1991000949 A1 1/1991

OTHER PUBLICATIONS

Kryptonite, Retractor Combo Cable Lock, Amazon, retrieved from: https://amazon.com/Kryptonite-Retractor-Combo-Cable-3-Fee/dp/B00FA5HDC8, 4 pages.

(Continued)

*Primary Examiner* — Lloyd A Gall
(74) *Attorney, Agent, or Firm* — Grossman, Tucker, Perreault & Pfleger, PLLC

(57) ABSTRACT

A retractable cable locking device, which includes a housing having a top and a bottom, a non-rotatable axle extending between the top and the bottom, a plurality of rotatable assemblies disposed within the housing where each rotatable assembly comprises a rotatable planar member and where each rotatable assembly can be separately rotated around the non-rotatable axle, a plurality of locking cables each having a first end which is attached to a different one of the plurality of planar members, a plurality of locking pins where each locking pin is disposed on a different distal end of a different locking cable, and a plurality of lock mechanisms wherein each lock mechanism will accept and fixture any one of the plurality of locking pins.

18 Claims, 6 Drawing Sheets

(56) References Cited

U.S. PATENT DOCUMENTS

| | | | | |
|---|---|---|---|---|
| 4,399,171 | A * | 8/1983 | Murray | A47G 33/0863 242/388.6 |
| 4,543,806 | A | 10/1985 | Papandrea et al. | |
| 4,607,984 | A | 8/1986 | Cassidy | |
| 4,970,882 | A | 11/1990 | Arrendondo | |
| 5,251,464 | A | 10/1993 | Halter | |
| D359,431 | S | 6/1995 | Motley | |
| 5,722,266 | A * | 3/1998 | Yeager | A45C 13/20 24/18 |
| 6,874,722 | B2 | 4/2005 | Wei | |
| D524,149 | S | 7/2006 | Kim | |
| 7,104,091 | B2 * | 9/2006 | Kuhblank | B62H 5/003 70/18 |
| 7,131,298 | B1 | 11/2006 | Haraughty | |
| 7,272,962 | B2 * | 9/2007 | Benda | E05B 67/006 70/18 |
| D588,442 | S | 3/2009 | Chong et al. | |
| D605,500 | S | 12/2009 | Lee et al. | |
| D610,717 | S | 2/2010 | Lin | |
| 7,685,850 | B2 * | 3/2010 | Nilsson | G09F 3/0329 70/18 |
| D630,086 | S | 1/2011 | Chou | |
| D646,154 | S | 10/2011 | Anderson | |
| D646,799 | S | 10/2011 | Yasher et al. | |
| 8,065,895 | B2 | 11/2011 | Andersen | |
| D654,778 | S | 2/2012 | Hines et al. | |
| 8,117,875 | B2 | 2/2012 | Ellis | |
| 8,196,945 | B2 | 6/2012 | Hensley | |
| D664,832 | S | 8/2012 | van der Vorst | |
| D679,988 | S | 4/2013 | Yamazaki | |
| D682,909 | S | 5/2013 | Kim | |
| 8,528,372 | B2 * | 9/2013 | Nilsson | E05B 73/0017 70/57.1 |
| D692,293 | S | 10/2013 | Toscani et al. | |
| D699,552 | S | 2/2014 | Wills | |
| D704,543 | S | 5/2014 | Kuhmichael | |
| D707,534 | S | 6/2014 | Crounse et al. | |
| 8,854,207 | B2 | 10/2014 | Williams | |
| D716,640 | S | 11/2014 | Martinson | |
| D717,157 | S | 11/2014 | Widdows et al. | |
| D722,489 | S | 2/2015 | Yamazaki | |
| D726,342 | S | 4/2015 | Rodriguez | |
| D728,831 | S | 5/2015 | Rodriguez | |
| D731,296 | S | 6/2015 | Nelson et al. | |
| D737,666 | S | 9/2015 | Rodriguez | |
| 9,447,611 | B2 | 9/2016 | Conti et al. | |
| 9,567,772 | B1 | 2/2017 | Snell | |
| 9,728,053 | B2 | 8/2017 | Napthine | |
| D880,281 | S * | 4/2020 | Sud | D8/356 |
| 2002/0170324 | A1 | 11/2002 | Wilson | |
| 2004/0226857 | A1 | 11/2004 | Wright et al. | |
| 2005/0223756 | A1 * | 10/2005 | Ling | E05B 73/0011 70/30 |
| 2007/0267552 | A1 | 11/2007 | Meyer | |
| 2009/0113946 | A1 | 5/2009 | Baumgarten | |
| 2010/0024993 | A1 | 2/2010 | Chou | |

OTHER PUBLICATIONS

Safeman, Bike Lock, Safeman USA, retrieved from: http://www.safemanusa.com/allaround.html, 1 page.

Office Action, dated Nov. 3, 2019, for U.S. Appl. No. 29/674,629, John Harris Sud, "Retractable Cable Locking Device," 8 pages.

* cited by examiner

RETRACTABLE CABLE LOCKING DEVICE

BACKGROUND

Field of the Invention

The disclosure relates to locking devices and more particularly pertains to a new locking device for securing articles with retractable cables.

SUMMARY OF THE INVENTION

Disclosed is a retractable cable locking device comprising a housing having a top and a bottom. Applicant's retractable cable locking device further comprises a non-rotatable axle extending between the top and the bottom, (N) rotatable assemblies disposed within the housing wherein each rotatable assembly comprises a rotatable planar member wherein each rotatable assembly can be separately rotated around the non-rotatable axle. In certain embodiments, (N) is greater than or equal to 3. Applicant's retractable cable locking device further comprises (N) locking cables each comprising a first end which is attached to a different one of the (N) planar members and each comprising a distal end. Applicant's retractable cable locking device further comprises (N) locking pins wherein each locking pin is disposed on a different distal end of a different locking cable. Applicant's retractable cable locking device further comprises (N) lock mechanisms, wherein each lock mechanism will accept and fixture any one of the (N) locking pins.

Further disclosed herein a method to releasably attach a bicycle to (N) stationary objects. In certain embodiments, (N) is greater than 3. In these embodiments, Applicant's method includes manually pulling a first distal end of a first locking cable outwardly from the retractable cable locking device, passing the first locking cable around and/or through a first stationary object, and locking a first locking pin in a first lock mechanism; manually pulling a second distal end of a second locking cable outwardly from the retractable cable locking device, passing the second locking cable around and/or through a second stationary object, and locking a second locking pin in a second lock mechanism, manually pulling a third distal end of a third locking cable outwardly from said retractable cable locking device, passing the third locking cable around and/or through a third stationary object, and locking a third locking pin in a third lock mechanism, and manually pulling a fourth distal end of a fourth locking cable outwardly from said retractable cable locking device, passing the fourth locking cable around and/or through a fourth stationary object, and locking a fourth locking pin in a fourth lock mechanism.

DETAILED DESCRIPTION OF THE PREFERRED EMBODIMENTS

Applicant's article of manufacture, i.e. retractable cable locking device, and method using same, are described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of Applicant's disclosure may be combined in any suitable manner in one or more embodiments. In the following description, numerous specific details are recited to provide a thorough understanding of embodiments of the disclosure. One skilled in the relevant art will recognize, however, that Applicant's disclosure may be practiced without one or more of the specific details, or with other methods, components, materials, and so forth. In other instances, well-known structures, materials, or operations are not shown or described in detail to avoid obscuring aspects of Applicant's disclosure, and it will be appreciated by those skilled in the art that it is intended to cover alternatives, modifications, and equivalents as may be included within the spirit and scope of Applicant's disclosure as defined by the appended claims and their equivalents as supported by the following disclosure and drawings.

Figure 1:
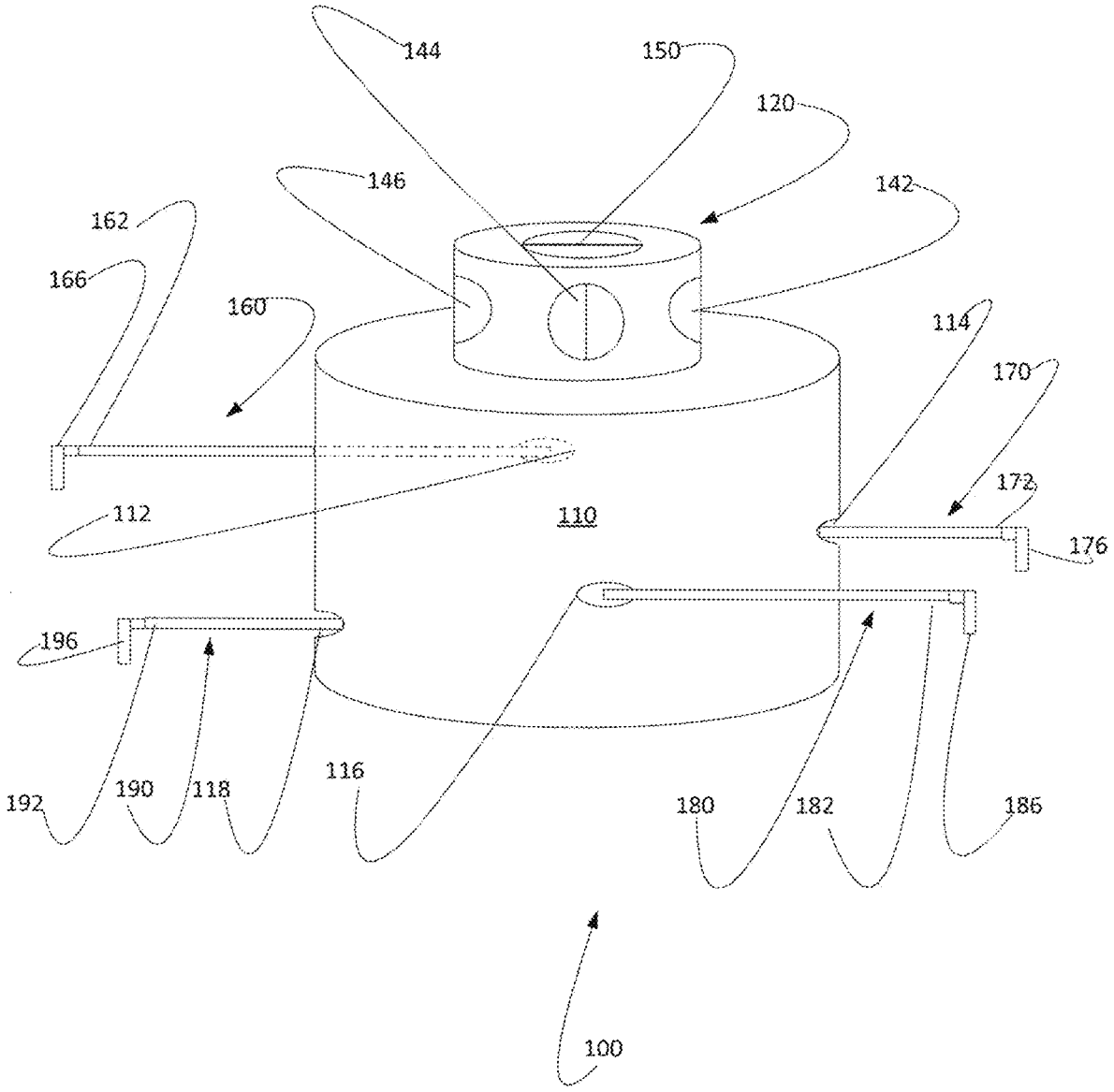
FIG. 1 is a perspective view of Applicant's retractable cable locking device.

Referring now to FIG. 1, Applicant's retractable cable locking device 100 comprises a first housing 110 and a second housing 120. As a general matter, housing 110 is formed to include one or more sides. In the illustrated embodiment of FIG. 1, housing 110 comprises a single curved side, i.e. a cylindrical shape. In other embodiments, housing 110 comprises a plurality of sides, such as and without limitation, 5 sides, 6 sides, 7 sides, 8 sides, and the like.

In certain embodiments, housing 110 comprises a maximum side to side distance of between about six (6) inches to about ten (10) inches. In certain embodiments, housing 110 comprises a maximum side to side distance of between about seven (7) inches to about nine (9) inches. In certain embodiments, housing 110 comprises a maximum side to side distance of about eight (8) inches.

In certain embodiments, housing 110 comprises a height between about three (3) inches and about eight (8) inches. In certain embodiments, housing 110 comprises a height between about four (4) inches and about seven (7) inches. In certain embodiments, housing 110 comprises a height of about five (5) inches.

As a general matter, housing 110 is formed to include a plurality of apertures extending therethrough. In the illustrated embodiment of FIG. 1, housing 110 is formed to include four (4) apertures extending therethrough, namely apertures 112 (shown in dotted lines in FIG. 1), 114, 116, and 118.

In the illustrated embodiment of FIG. 1, a distal end of four (4) locking cables, namely locking cables 160, 170, 180, and 190, extend outwardly from apertures 112, 114, 116, and 118, respectively. Locking pins 166, 176, 186, and 196, are disposed on the distal ends 162, 172, 182, and 192, respectively, of locking cables 160, 170, 180, and 190, respectively.

Second housing 120 is disposed on top of first housing 110. In certain embodiments, housing 120 comprises a single curved side, i.e. a cylindrical shape. In other embodiments, housing 120 comprises a plurality of sides, such as and without limitation, 5 sides, 6 sides, 7 sides, 8 sides, and the like. In certain embodiments, housing 120 comprises a height between about one half (0.5) inches and about two (2) inches. In certain embodiments, housing 120 comprises a height of about one (1) inch.

In certain embodiments, housing 110 and housing 120 are formed from a polymeric material, such as and without limitation, polycarbonate. In these embodiments, housing 110 and/or housing 120, are formed by 3-D printing techniques and apparatus. Further in these embodiments, housing 110 and/or housing 120 are formed by injection molding. In certain embodiments, housing 110 and/or housing 120 are formed from one or more metals.

Four (4) lock mechanisms, namely lock mechanisms 142, 144, 146, and 148 (not shown in FIG. 1), are disposed within second housing 120. Each lock mechanism 142, 144, 146, and 148, can accept and fixture one of locking pins 166, 176, 186, or 196. Lock mechanisms 142, 144, 146, and 148, are configured such that one key can lock, and unlock, all of lock mechanisms 142, 144, 146, and 148. That one key can be inserted into key aperture 150 and rotated in a first direction to lock all of lock mechanisms 142, 144, 146, and 148, or rotated in a second and opposite direction to unlock all of lock mechanisms 142, 144, 146, and 148.

Figure 2:
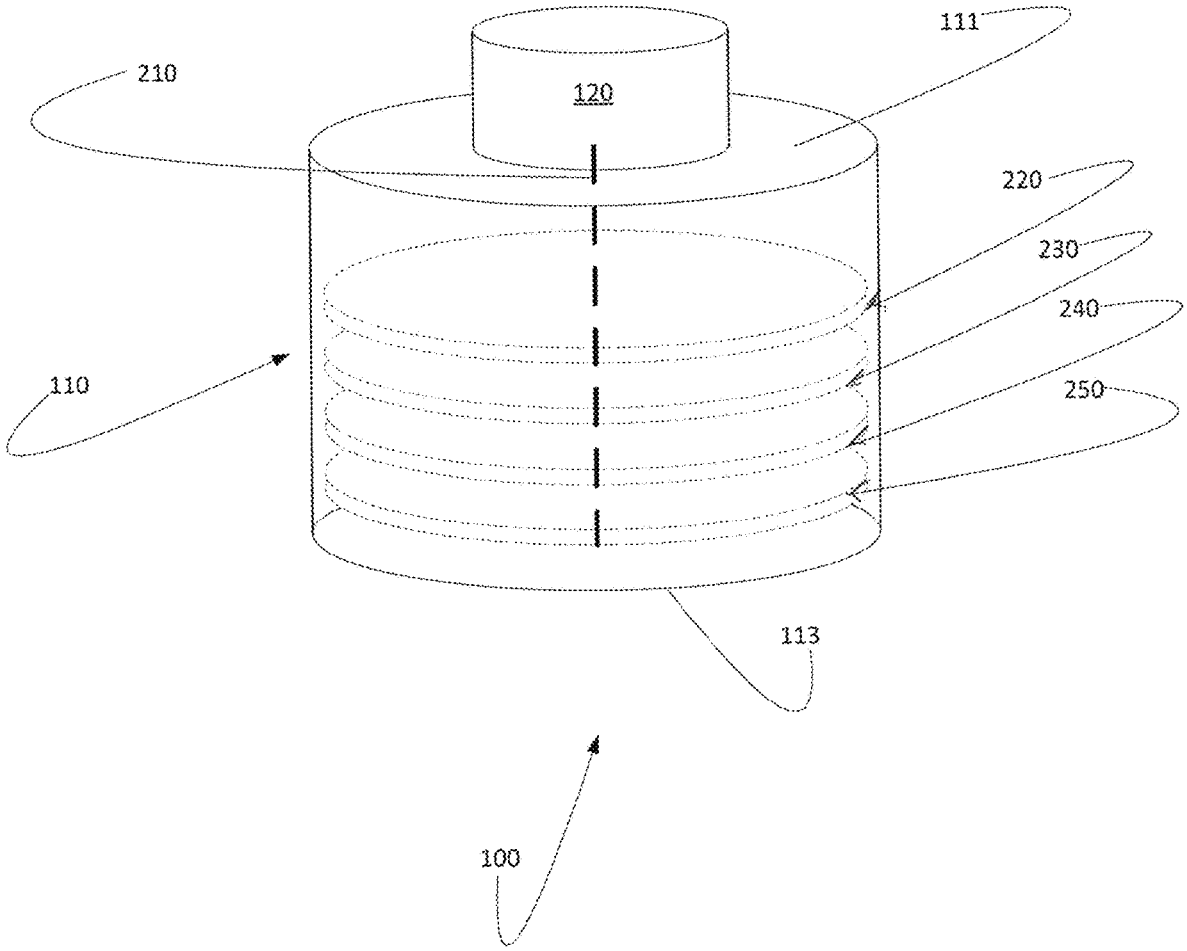
FIG. 2 illustrates certain elements disposed within a housing for Applicant's retractable cable locking device.

FIG. 2 illustrates certain elements disposed within first housing 110, including a plurality of assemblies configured to be rotatable around a stationary axle 210. In the illustrated embodiment of FIG. 2, Applicant's manufacture 100 comprises a stationary, i.e. non-rotatable axle 210, and four (4) rotatable assemblies, namely rotatable assemblies 220, 230, 240, and 250.

As a general matter, axle 210 comprises a length equal to the height of housing 110 in which that axle 210 is disposed. In certain embodiments, axle 210 comprises a diameter between about 1/16 inch and about 1/4 inch. In certain embodiments, axle 210 comprises a diameter of about 1/8 inch.

Further disclosed in FIG. 2 is a top portion 111, and a bottom portion 113, of first housing 110. Axle 210 is fixed to both top portion 111, and bottom portion 113, of first housing 110. Axle 210 passes through a center point in each of rotatable assemblies 220, 230, 240, and 250, such that each rotatable assembly 220, 230, 240, and 250, can be caused to rotate around axle 210 independent of the remaining rotatable assemblies which may remain stationary.

Figure 3:
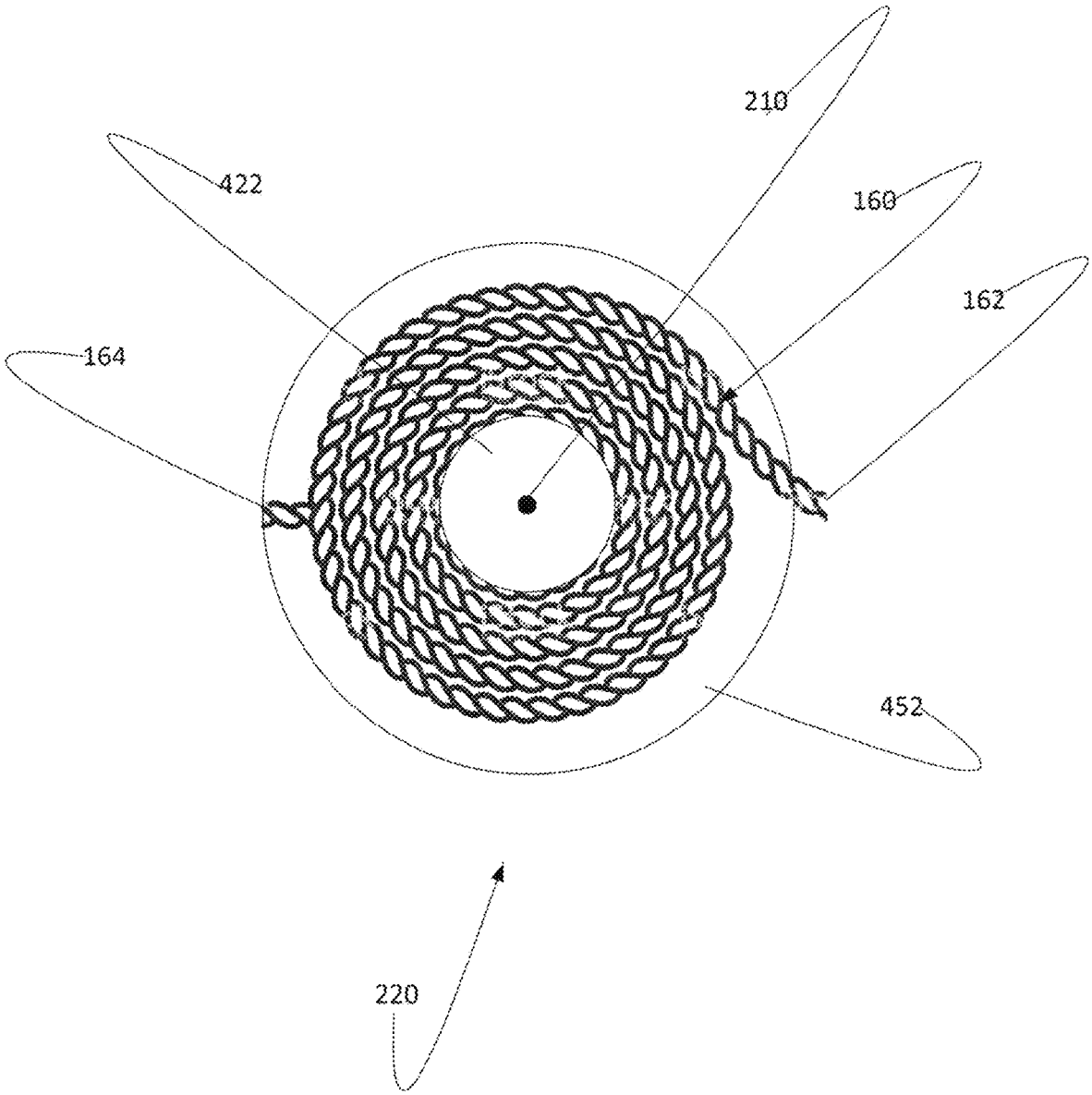
FIG. 3 illustrates a top view of a rotatable assembly rotatably disposed with the housing.
Figure 4:
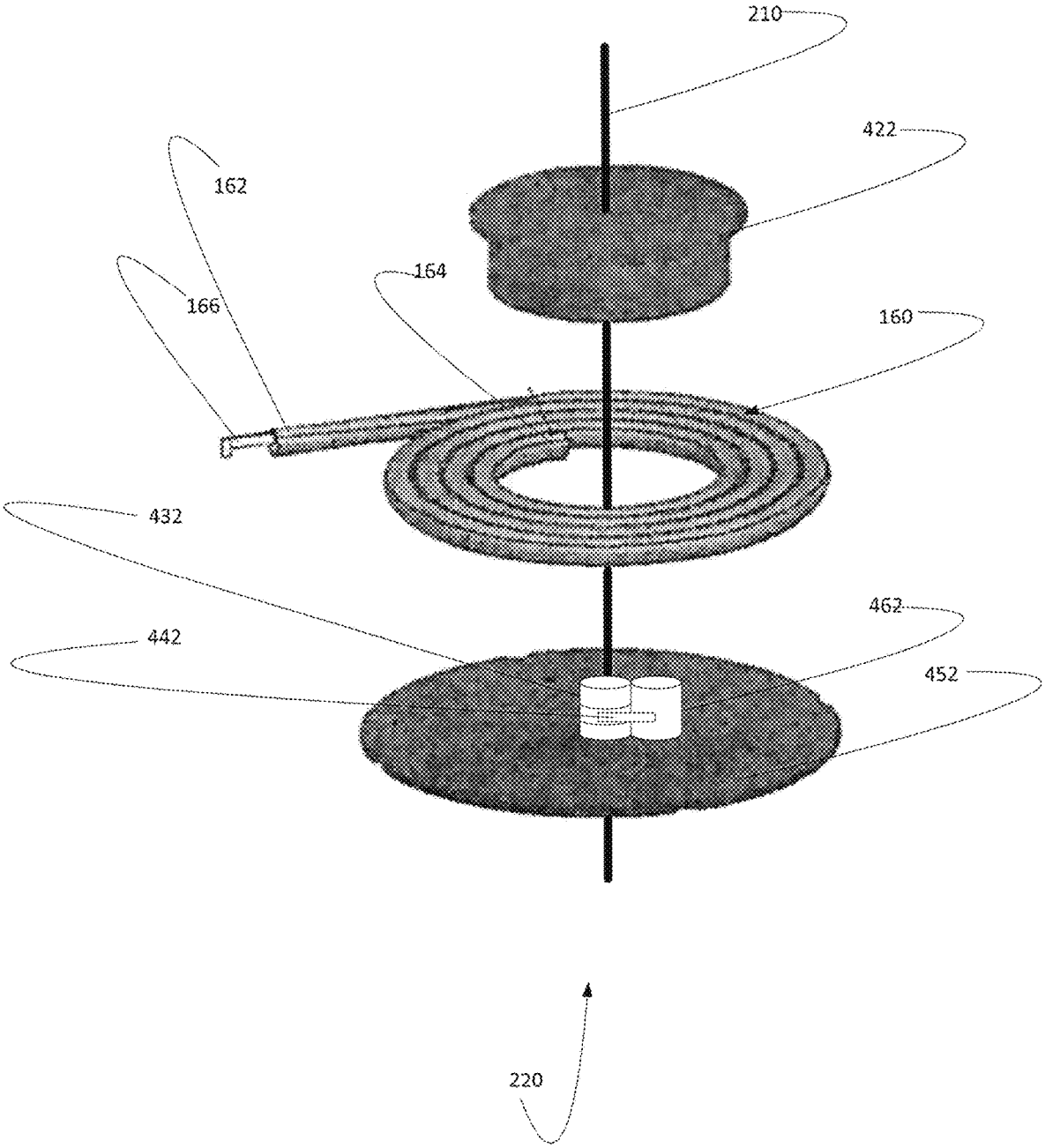
FIG. 4 is a perspective view illustrating various elements disposed in the rotatable assembly of FIG. 3.

Referring now to FIGS. 3 and 4, FIG. 3 is a top view of a portion of rotatable assembly 220. FIG. 4 is a perspective view illustrating certain elements disposed in rotatable assembly 220. Rotatable assembly 220 comprises a circular, planar member 452 (FIG. 4), a locking cable 160 (FIG. 3), a spool top 422 (FIG. 4), a center spool 432 (FIG. 4), a side spool 462 (FIG. 4), and a constant force spring 442 (FIG. 4). Spool top 422 (FIG. 4) covers center spool 432 (FIG. 4), side spool 462 (FIG. 4), and constant force spring 442 (FIG. 4).

In the nested configuration shown in FIG. 3, a distal end 162 of locking cable 160 extends outwardly from first housing 110, and a proximal end 164 is attached to circular, planar member 452. The remainder of locking cable 160 remains within first housing and wound spool top 422. Stationary axle 210 passes through spool top 422, center spool 432, and planar member 452.

Constant force spring 442 is disposed around center spool 432 and attached to side spool 462. Manually pulling distal end 162 of locking cable 160 outwardly from first housing 110, causes center spool 432 to rotate, which generates torsional forces in constant force spring 442. When the force pulling distal end 162 outwardly is released, the torsional forces in constant force spring 442 causes locking cable 160 to retract inwardly, and back into the nested configuration shown in FIG. 3.

Figure 5:
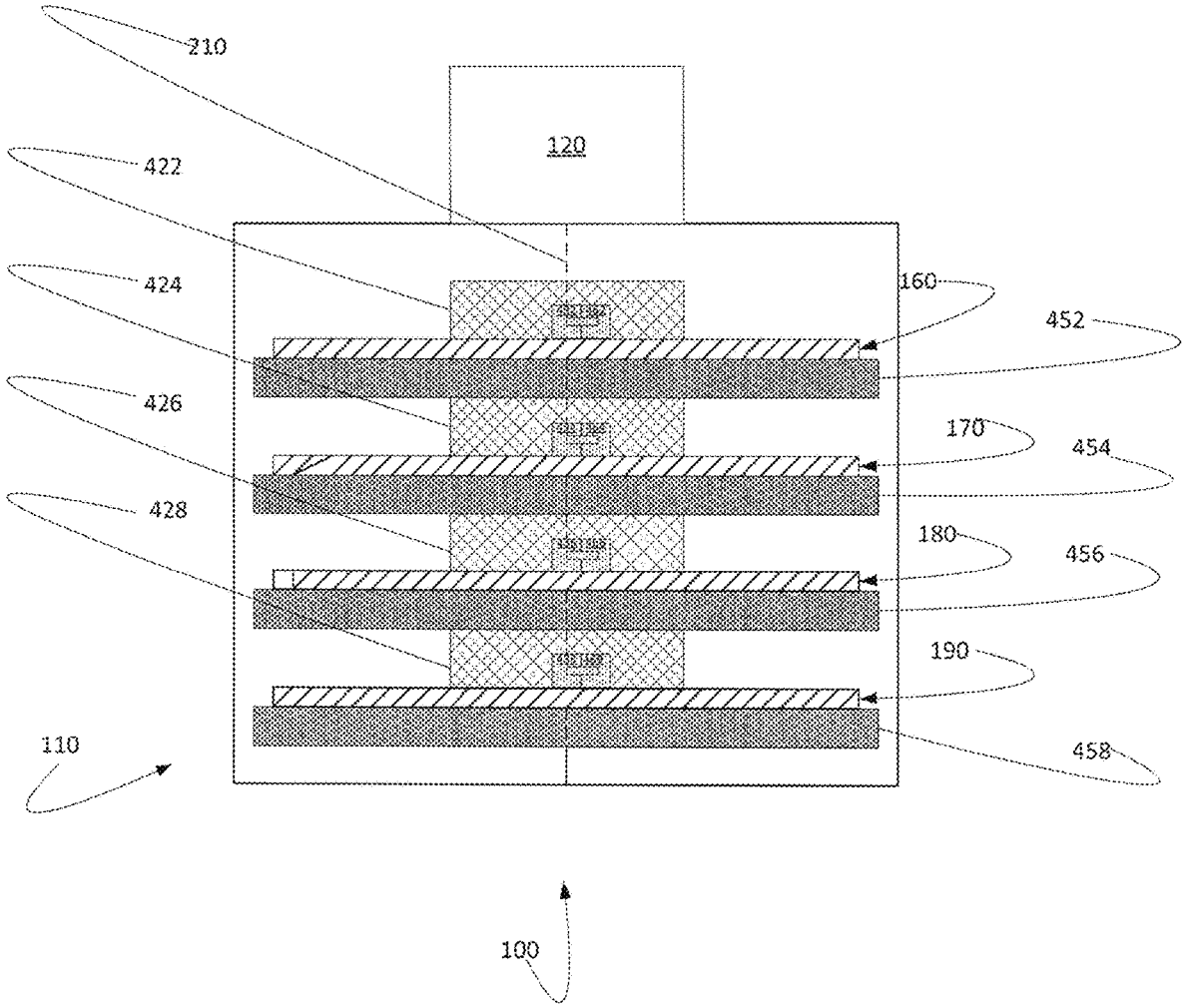
FIG. 5 is a cross-section view of Applicant's retractable cable locking device.

FIG. 5 illustrates Applicant's assembly 100 in cross-section. Each of rotatable assemblies 230, 240, and 250, are configured as is rotatable assembly 220 as described hereinabove, and each comprises the same elements described herein above with respective to rotatable assembly 220 as described hereinabove. This being the case, stationary axle 210 is attached to top portion 111 of first housing 110, passes through a center point in spool top 422, center spool 432, planar member 452, spool top 424, center spool 434, planar member 454, spool top 426, center spool 436, planar member 456, spool top 428, center spool 438, planar member 458, and is attached to bottom portion 113 of first housing 110.

Figure 6:
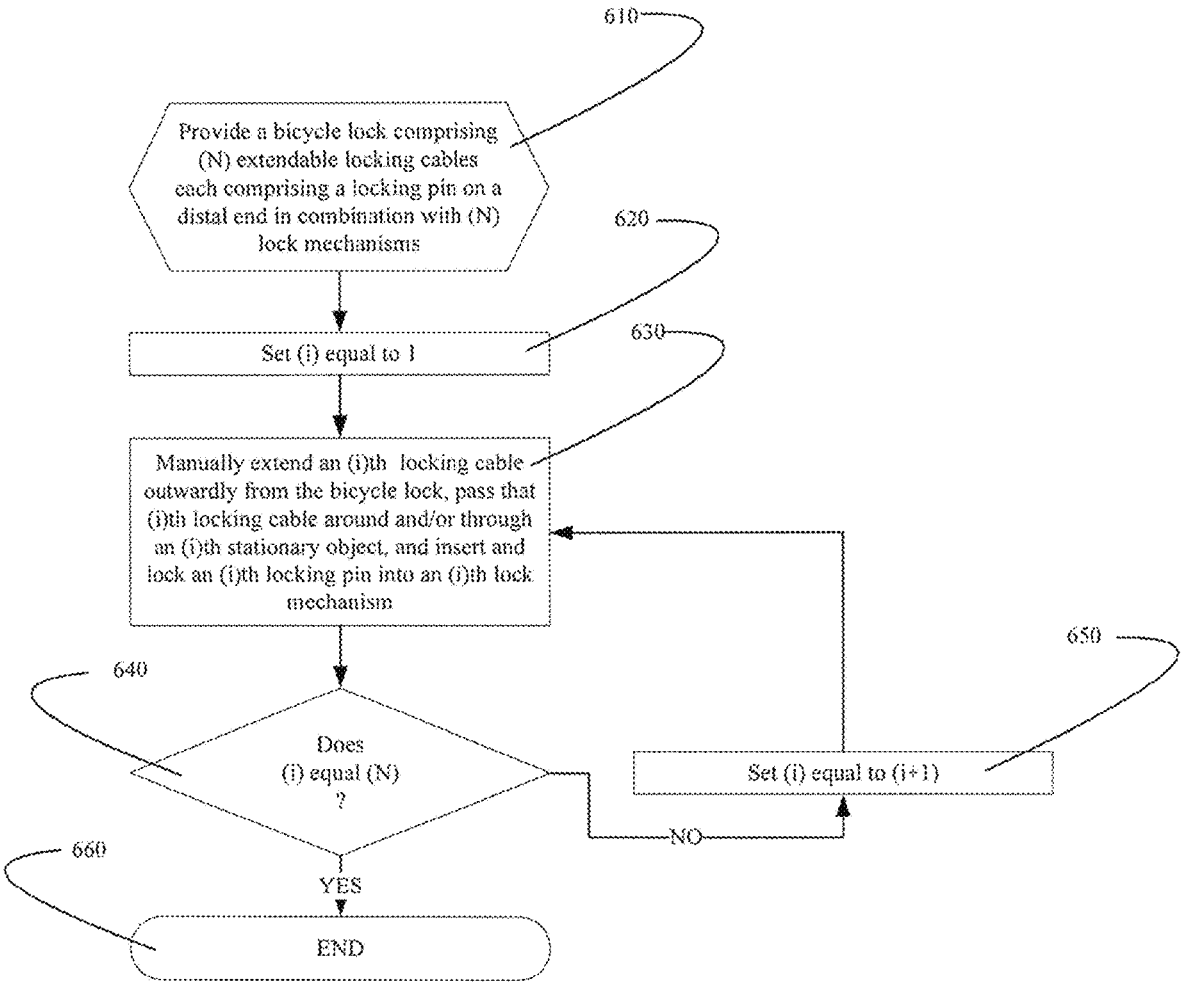
FIG. 6 is a flow chart summarizing a method to releasably attach a bicycle to a plurality of physical objects using Applicant's retractable cable locking device.

FIG. 6 summarizes Applicant's method to releasably attach a bicycle to a stationary object. By "stationary object," Applicant means a physical object that is too heavy to be carried by a single person. Referring now to FIG. 6, in step 610 the method provides a retractable cable locking device comprising (N) extendable locking cables each comprising a locking pin on a distal end in combination with (N) lock mechanisms. In step 620, the method sets (i) equal to 1.

In step 630, the method manually extends an (i)th locking cable outwardly from the retractable cable locking device, and passes that (i)th locking cable around and/or through an (i)th stationary object, and inserts and locks an (i)th locking pin into an (i)th lock mechanism, wherein (i) is greater than 1 and less than or equal to (N).

In step 640, the method determines if each of the (N) locking cables has been utilized. More specifically, in step 640 the method determines if (i) equals (N). If (i) does not equal (N), then the method transitions to step 650 wherein the method sets (i) equal to (i+1). The method transitions from step 650 to step 630 and continues as described herein.

Alternatively, if the method determines in step 640 that (i) does equal (N), then the method transitions to step 660 and ends.

While the preferred embodiments of the present invention have been illustrated in detail, it should be apparent that modifications and adaptations to those embodiments may occur to one skilled in the art without departing from the scope of Applicant's disclosure.

I claim:

1. A retractable cable locking device, comprising:

a housing having a top and a bottom;

a non-rotatable axle extending between the top and the bottom;

(N) rotatable assemblies disposed within the housing, wherein each rotatable assembly comprises a rotatable planar member, and wherein each rotatable assembly can be separately rotated around the non-rotatable axle, wherein (N) is equal to or greater than 3;

(N) locking cables, each comprising a first end which is attached to a different one of the (N) planar members and each comprising a distal end;

(N) locking pins, wherein each locking pin is disposed on a different distal end of a different locking cable;

(N) lock mechanisms, wherein each lock mechanism will accept and fixture any one of the (N) locking pins.

2. The retractable cable locking device of claim 1, wherein (N) equals four.

3. The retractable cable locking device of claim 1, wherein (N) is greater than four.

4. The retractable cable locking device of claim 1, wherein said housing, said top, and said bottom, comprise an integral sub-assembly.

5. The retractable cable locking device of claim 4, wherein said integral sub-assembly is formed from metal.

6. The retractable cable locking device of claim 4, wherein said integral sub-assembly is formed by injection molding an engineering thermoplastic.

7. The retractable cable locking device of claim 1, wherein each of said (N) lock mechanisms can be opened using a same key.

8. The retractable cable locking device of claim 1, wherein each rotatable assembly comprises one locking cable, one rotatable center spool attached to a rotatable planar member, one constant force spring coupled to said center spool, and a spool top covering the center spool and constant force spring;

wherein said non-rotatable axle passes through a center point in each spool top, center spool, and planar member.

9. The retractable cable locking device of claim 8, wherein:

exerting a force on a distal end of a locking cable to pull that locking cable outwardly from said first housing causes an attached planar member to rotate, which causes an attached center spool to rotate, which creates torsional retraction forces in said constant force spring;

release of said force causes said constant force spring to rotate the attached center spool and planar member in a second and opposite direction thereby retracting said locking cable into said housing.

10. The retractable cable locking device of claim 1, wherein each of said (N) locking cables comprises braided steel wire.

11. The retractable cable locking device of claim 10, wherein each of said plurality of braided steel wires is disposed within an elastomeric covering.

12. A method to releasably attach a bicycle to a plurality of physical objects using the retractable cable locking device of claim 9, comprising:

manually pulling a first distal end of a first locking cable outwardly from said first housing, passing the first locking cable around and/or through a first stationary object, and locking a first locking pin in a first lock mechanism;

manually pulling a second distal end of a second locking cable outwardly from said housing, passing the second locking cable around and/or through a second stationary object, and locking a second locking pin in a second lock mechanism;

manually pulling a third distal end of a third locking cable outwardly from said housing, passing the third locking cable around and/or through a third stationary object, and locking a third locking pin in a third lock mechanism; and manually pulling a fourth distal end of a fourth locking cable outwardly from said housing, passing the fourth locking cable around and/or through a fourth stationary object, and locking a fourth locking pin in a fourth lock mechanism.

13. The method of claim 12, further comprising forming said housing, said top, and said bottom, to comprise an integral sub-assembly.

14. The method of claim 13, comprising forming said integral sub-assembly from metal.

15. The method of claim 13, comprising forming said integral sub-assembly by injection molding an engineering thermoplastic.

16. The method of claim 12, comprising opening each of said (N) lock mechanisms using a same key.

17. The method of claim 12, further comprising forming each of said plurality of locking cables to comprise braided steel wire.

18. The method of claim 17, further comprising encasing each of said plurality of braided steel wires with an elastomeric covering.

* * * * *